United States Patent [19]

Idota et al.

[11] 4,022,677

[45] May 10, 1977

[54] ELECTROLYTIC CELL

[75] Inventors: Yoshio Idota; Haruo Shibaoka, both of Minami-ashigara, Japan

[73] Assignee: Fuji Photo Film Co., Ltd., Japan

[22] Filed: Feb. 23, 1976

[21] Appl. No.: 660,385

[30] Foreign Application Priority Data

Feb. 21, 1975 Japan ..... 50-23856[U]

[52] U.S. Cl. ..... 204/263; 204/272; 204/273; 204/275

[51] Int. Cl.[2] ..... C25C 1/20; C25C 7/00

[58] Field of Search ..... 204/46 R, 151, 260, 204/261, 263, 272, 273, 275, 269

[56] References Cited

UNITED STATES PATENTS

| | | | |
|---|---|---|---|
| 1,901,652 | 3/1933 | Kean | 204/151 |
| 2,110,930 | 3/1938 | Doffin | 204/46 R |
| 2,545,566 | 3/1951 | Booe | 204/46 R X |
| 2,606,148 | 8/1952 | Portanova et al. | 204/260 X |
| 3,632,497 | 1/1972 | Leduc | 204/263 |
| 3,682,798 | 8/1972 | Tuddenham et al. | 204/263 X |

*Primary Examiner*—Arthur C. Prescott

[57] ABSTRACT

An electrolytic cell for recovering a metal from a solution has a diaphragm between a cathode and an anode. The diaphragm is supported by a support frame composed of a number of support columns. At least two of the support columns are made hollow in structure. A solution supply port is provided in at least one of the hollow support columns and a solution take-out port is provided in each of the remaining hollow support columns.

9 Claims, 4 Drawing Figures

ELECTROLYTIC CELL

BACKGROUND OF THE INVENTION

1. Field of the Invention

This invention relates to an electrolytic cell for recovering a metal from a solution containing metal ions, and more particularly to an electrolytic cell for recovering silver from a fixing solution for a photographic process (hereinafter referred to simply as "fixer").

2. Description of the Prior Art

It has been known in the art to use an electrolytic cell which employs a diaphragm between the cathode and the anode thereof to recover silver from a fixer and at the same time to reclaim the fixer. In this type of electrolytic cell, a fixer to be electrolyzed is supplied into the space between the diaphragm and the cathode and the electrolyzed fixer is taken out of said space. The flow passage of the fixer supplied into the electrolytic cell should be so designed that the fixer will be effectively electrolyzed.

SUMMARY OF THE INVENTION

In view of the above described requirement, the primary object of the present invention is to provide an electrolytic cell which effectively electrolyzes a solution supplied thereinto.

Another object of the present invention is to provide an electrolytic cell in which a solution can be smoothly supplied into and taken out of the space between the diaphragm and the cathode thereof.

Still another object of the present invention is to provide an electrolytic cell of small size which is easy to operate and is capable of continuously electrolyzing a solution supplied thereto.

The above objects are accomplished by providing in the electrolytic cell a diaphragm support means which is hollow in structure and provided with a solution supplying port and a solution take-out port. In accordance with the particular construction of the electrolytic cell of this invention, the period during which the solution stays in the cell is elongated to perform a sufficient electrolyzation. Further, since the diaphragm support means functions as a baffle means, the solution is sufficiently electrolyzed and the electrolytic efficiency is enhanced.

The electrolytic cell in accordance with the present invention is particularly suitable for the recovery of silver in a fixer, but can be applied to various types of recovery of metals from a solution containing metal ions.

DESCRIPTION OF THE PREFERRED EMBODIMENTS

Figure 1:
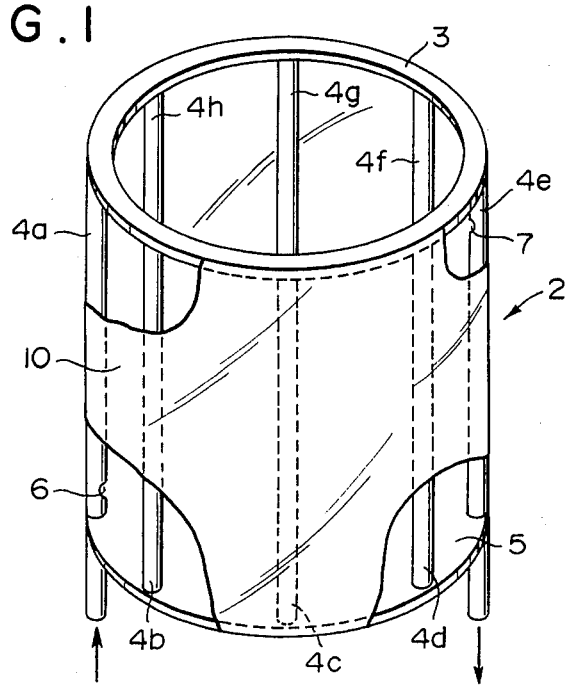
FIG. 1 is a perspective view of a diaphragm support member employed in the electrolytic cell in accordance with an embodiment of the present invention.
Figure 2:
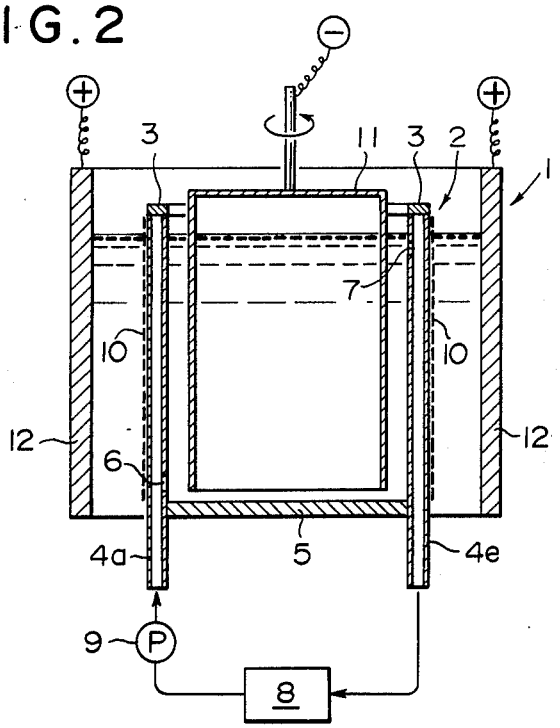
FIG. 2 is a schematic side sectional view of the electrolytic cell employing the diaphragm support member as shown in FIG. 1.

Referring to FIGS. 1 and 2 showing an embodiment of the present invention, a cylindrical diaphragm support frame 2 is provided in an electrolytic cell 1. The diaphragm support frame 2 consists of an upper annular frame 3, a lower circular bottom 5 and parallel support columns 4*a* to 4*h* fixed to the upper frame 3 and the bottom 5. Of the eight columns 4*a* to 4*h*, six extend vertically from the bottom 5 to the upper annular frame 3 and two columns, 4*a* and 4*e*, extend downward at the lower end thereof beyond the bottom 5 as shown in FIG. 1. The two columns 4*a* and 4*e* are made hollow in structure and one column 4*a* is provided with a fixer supply port 6 on the inner side of the lower part thereof. The other column 4*e* is provided with a fixer take-out port 7 on the inner side of the upper part thereof. The two hollow columns 4*a* and 4*e* for supplying and taking out the fixer are communicated with a storage tank 8. Between the storage tank 8 and the fixer supplying column 4*a* is provided a pump 9 for feeding the fixer into the supplying column 4*a* from the storage tank 8. A diaphragm 10 of cylindrical form is attached to the diaphragm support frame 2 to cover the support columns 4*a* to 4*h* as shown in FIG. 1.

The cylindrical diaphragm support frame 2 carrying the diaphragm 10 is put into an electrolytic cell 1 between an outer cylindrical anode 12 and an inner rotatable cylindrical cathode 11 thereof so that a annular space is formed between the diaphragm 10 and the cathode 11 and another annular space is formed between the diaphragm 10 and the anode 12. The fixer is circulated through the fixer take-out column 4*e*, the storage tank 8, the pump 9 and the fixer supply column 4*a*, the space between the diaphragm 10 and the cathode 11, and then back to the fixer take-out column 4*e*. While repeating the circulation, silver ions in the fixer are recovered and the fixer is reclaimed. The circulation of the fixer is repeated until the concentration of the silver ion in the fixer becomes a predetermined desired level.

The position of the fixer supply port 6 and that of the fixer take-out port 7 are not limited to those shown in FIGS. 1 and 2. Since, however, the period of stay of the fixer in the electrolytic cell 1 is preferred to be as long as possible to perform effective electrolyzation, the supply port 6 and the take-out port 7 should preferably be separated as far as possible. It will be noted that the number of the support columns 4*a*–4*h* may be arbitrarily selected. However, since the solution outside the diaphragm 10 cannot be reclaimed nor used for recovery of silver, the space between the diaphragm 10 and the anode 12 should preferably be as small as possible. Therefore, the horizontal cross-section of the diaphragm 10 is desired to be as close to circular as possible. Further, from the viewpoint of reinforcement of the diaphragm 10, the number of the columns is also desired to be as large as possible. Thus, the number of support columns 4*a*–4*h* including the fixer supply and take-out columns 4*a* and 4*e* should preferably be more than five.

Figure 3:
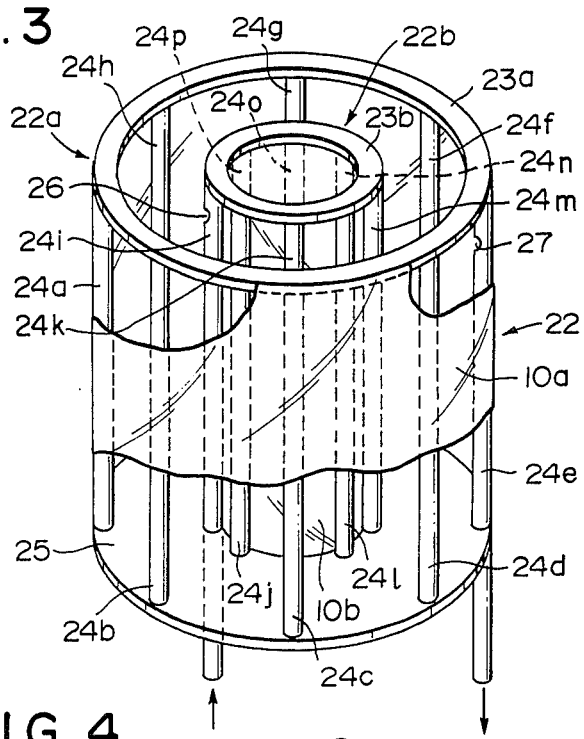
FIG. 3 is a perspective view of a diaphragm support member employed in the electrolytic cell in accordance with another embodiment of the present invention.
Figure 4:
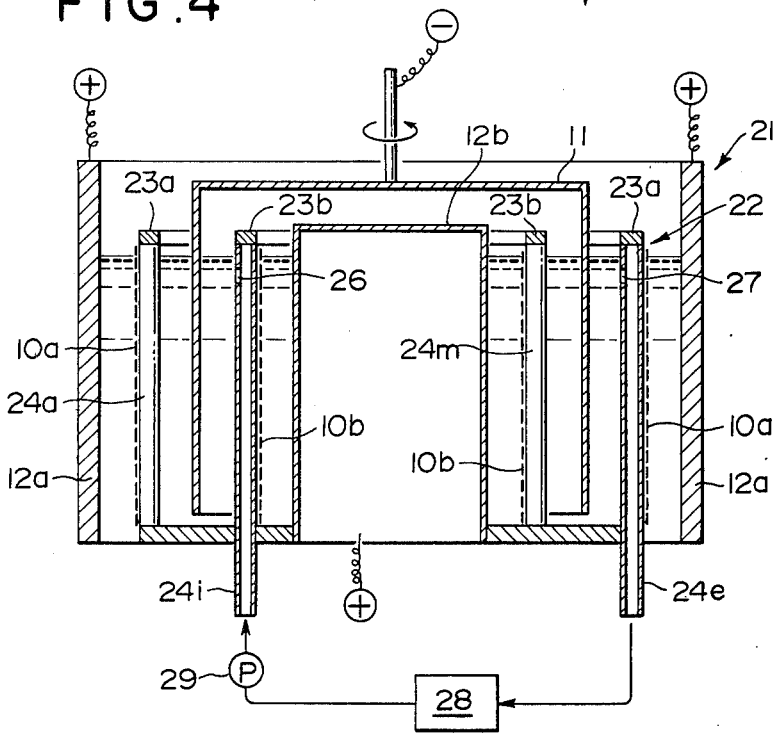
FIG. 4 is a schematic side sectional view of the electrolytic cell employing the diaphragm support member as shown in FIG. 3.

Another embodiment of the invention employing two diaphragms inside and outside the cathode and two anodes one located within the inner diaphragm and the other located outside the other diaphragm is illustrated in FIGS. 3 and 4. In this embodiment, a double diaphragm structure 22 as shown in FIG. 3 is used. The double diaphragm structure 22 comprises an inner diaphragm 10*b* attached to an inner diaphragm support frame 22*b* and an outer diaphragm 10*a* attached to an outer diaphragm support frame 22*a*. The outer diaphragm support frame 22*a* having eight support columns 24*a*–24*h* and the outer diaphragm 10*a* attached on the outer side thereof are equivalent to those employed in the first embodiment as shown in FIG. 1 except that the outer diaphragm support frame 22*a* has only one hollow support column 24*e* extending downward from a bottom 25. A solution take-out port 27 is provided on the inner side of the upper part of the hollow column 24*e*. The inner diaphragm support frame 22*b* carries the diaphragm 10*b* on the inner side thereof. The inner diaphragm support frame 22*b* has eight support columns 24*i*–24*p* one of which 24*i* is hollow and extends downward below the bottom 25. The hollow support column 24*i* is provided with a solution supply port 26 on the outer side of the upper part thereof.

An electrolytic cell 21 of this embodiment has two anodes 12*a* and 12*b* concentrically provided to form an annular space therebetween as shown in FIG. 4. Into the annular space is inserted said double diaphragm structure 22 concentrically with the anodes 12*a* and 12*b*. A cylindrical rotatable cathode 11 is inserted between the outer and inner diaphragms 10*a* and 10*b* so that the cathode 11 will rotate between the diaphragms 10*a* and 10*b*. The solution such as a fixer is supplied into the space between the two diaphragms 10*a* and 10*b* from the supply port 26 formed on the outer side of a column 24*i* of the inner diaphragm support frame 22*b*. After electrolyzed, the solution is taken out of the space from the take-out port 27 formed on the inner side of a column 24*e* of the outer diaphragm support frame 22*a*. The solution taken out through the take-out port 27 is fed to a storage tank 28 and silver is recovered here. The solution is then reclaimed by being fed into the space between the diaphragms 10*a* and 10*b* by a pump 29.

In the above described second embodiment of the present invention, the electrolytic efficiency can be enhanced by the double diaphragm structure.

It will be noted that the solution need not always be circulated in a single electrolytic cell. For instance, it is possible to connect several electrolytic cells in series to successively electrolyze the solution. Further, it is also possible to electrolyze the solution only once by a batch system when the electrolytic efficiency is sufficiently high or said predetermined desired level of the silver concentration is not so low. Furthermore, the shape of the cathode or the type of the electrolytic cell is not limited to that disclosed hereinabove, but may be, for instance, of multi-layer disc type wherein a number of disc shaped cathodes are accumulated with spaces formed therebetween.

We claim:

1. An electrolytic cell comprising a cathode, an anode and a diaphragm provided therebetween wherein the improvement comprising a diaphragm support means including a plurality of support columns to which said diaphragm is attached, at least two of said support columns being made hollow in structure, one of said hollow support columns being provided with a solution supply port, another of said hollow support columns being provided with a solution take-out port.

2. An electrolytic cell as defined in claim 1 wherein said diaphragm support means comprises a disc-shaped bottom member, an upper annular member having substantially the same size as that of said bottom member, and a plurality of diaphragm support columns extending parallel to each other between said bottom member and said upper annular member.

3. An electrolytic cell as defined in claim 2 wherein the number of said support columns is more than five.

4. An electrolytic cell as defined in claim 1 wherein said solution supply port and said solution take-out port provided on the hollow columns are faced to said cathode.

5. An electrolytic cell as defined in claim 1 wherein one of said ports is provided on the lower part of the column and the other is provided on the upper part of the column.

6. An electrolytic cell comprising a cylindrical cathode, an inner anode provided concentrically with the cathode within said cathode, an outer cylindrical anode provided concentrically with the cathode outside said cathode, an inner diaphragm of cylindrical shape provided between said cathode and said inner anode, and an outer diaphragm of cylindrical shape provided between said cathode and said outer anode wherein the improvement comprising a diaphragm support means including a plurality of support columns to which said diaphragms are attached, at least one of the columns to which said inner diaphragm is attached and at least one of the columns to which said outer diaphragm is attached are made hollow in structure, one of said hollow support columns being provided with a solution supply port, another of said hollow support columns being provided with a solution take-out port.

7. An electrolytic cell as defined in claim 6 wherein said ports provided on the hollow columns are faced to said cathode.

8. An electrolytic cell as defined in claim 6 wherein the number of said support columns to which said inner diaphragm is attached is more than five.

9. An electrolytic cell as defined in claim 7 wherein the number of said support columns to which said outer diaphragm is attached is more than five.

* * * * *